United States Patent [19]

Pickering et al.

[11] 4,154,005

[45] May 15, 1979

[54] DRYING APPARATUS

[75] Inventors: Edgar Pickering; Leslie Mellor, both of Blackburn, England

[73] Assignee: Edgar Pickering (Blackburn) Limited, Blackburn, England

[21] Appl. No.: 858,028

[22] Filed: Dec. 6, 1977

[30] Foreign Application Priority Data

Dec. 10, 1976 [GB] United Kingdom ..... 51705/76

[51] Int. Cl.[2] ..... F26B 13/02; F26B 13/20

[52] U.S. Cl. ..... 34/155; 28/180

[58] Field of Search ..... 28/179, 180, 181; 26/92; 34/155, 156

[56] References Cited

U.S. PATENT DOCUMENTS

| | | | |
|---|---|---|---|
| 2,008,230 | 7/1935 | Spooner | 34/156 X |
| 2,099,162 | 11/1937 | Eberlin | 34/155 X |
| 2,255,859 | 9/1941 | Quigley | 34/155 X |
| 2,601,080 | 6/1952 | Andrews | 28/180 X |
| 2,851,763 | 9/1958 | Adams | 28/180 |
| 2,927,363 | 3/1960 | Park | 28/181 X |
| 3,070,901 | 1/1963 | Allander et al. | 34/156 |
| 3,449,808 | 6/1969 | Kuroda | 28/180 |
| 3,623,235 | 11/1971 | Smith | 34/155 |
| 3,758,960 | 9/1973 | McCreary et al. | 34/156 |

*Primary Examiner*—Louis Rimrodt

*Attorney, Agent, or Firm*—Watson, Cole, Grindle & Watson

[57] ABSTRACT

A drier, comprising an enclosed casing, means for feeding a sheet of parallel yarns to be dried through the casing in at least one substantially horizontal pass, nozzle boxes disposed above and below the sheet material in each pass to form a drying chamber, means for introducing hot air into the nozzle boxes, and slots in the walls of the nozzle boxes which face the sheet, said slots constituting nozzles effective to discharge hot air from each nozzle box onto the opposed surfaces of the sheet at an angle to the vertical in the range of 30° to 60° and the slots in the upper and lower boxes being slanted in opposite directions to the direction transverse to the direction of travel of the sheet.

5 Claims, 4 Drawing Figures

DRYING APPARATUS

This invention provides a drier, which is primarily intended for drying a sheet of parallel yarns following dyeing but which is also useful for drying a tufted carpet following application of synthetic rubber latex to the back of the carpet for the purpose of bonding the loop or cut pile tufts to the backing fabric.

Existing driers for a horizontally travelling sheet of yarns direct streams of hot air at right angles against the top and bottom surfaces of the sheet, but this arrangement is inefficient and is unsuitable for drying yarns travelling at a speed as high as 100 ft. per minute.

The present invention provides a drier, comprising an enclosed casing, means for feeding a sheet of parallel yarns to be dried through the casing in at least one substantially horizontal pass, nozzle boxes disposed above and below the sheet material in each pass to form a drying chamber, means for introducing hot air into the nozzle boxes, and slots in the walls of the nozzle boxes which face the sheet, said slots constituting nozzles effective to discharge hot air from each nozzle box onto the opposed surfaces of the sheet at an angle to the vertical in the range of 30° to 60° and the slots in the upper and lower boxes being slanted in opposite directions to the direction transverse to the direction of travel of the sheet.

When the hot air is directed on a sheet of yarns in this way, the yarns interfere with the flow of the air and create turbulence. The result is an increase in drying efficiency of at least 40% for a given input of energy in comparison with a drier in which the air impinges at right angles upon the yarns.

Preferably the hot air is discharged onto each surface of the sheet at an angle of 30° to the vertical and the slots above and below the sheet are slanted at the same angle to the direction transverse to the direction of travel of the sheet.

One embodiment of drier according to the invention is illustrated, by way of example, in the accompanying drawings, in which.

Figure 1:
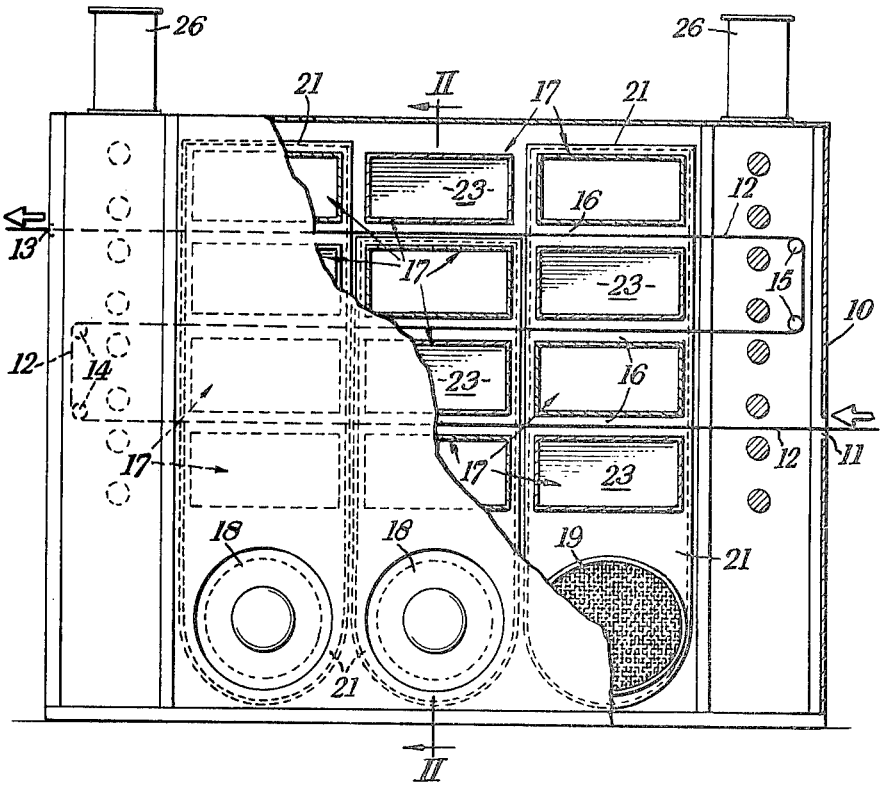
FIG. 1 is a view of the drier in elevation, partly in section.

The drier shown in the drawings includes a box-like casing 10, which is enclosed at its top, bottom, sides and ends but has an inlet 11 at one end for a sheet of parallel yarns 12 to be dried and an outlet 13 for the sheet at its other end. As shown in FIG. 1 the yarns travel through the casing around rollers 14 and 15, the rollers 14 serving to feed the yarns, in a series of superposed passes in which it travels in opposite directions. The speed of advance of the yarns is typically 100 ft. per minute.

Figure 2:
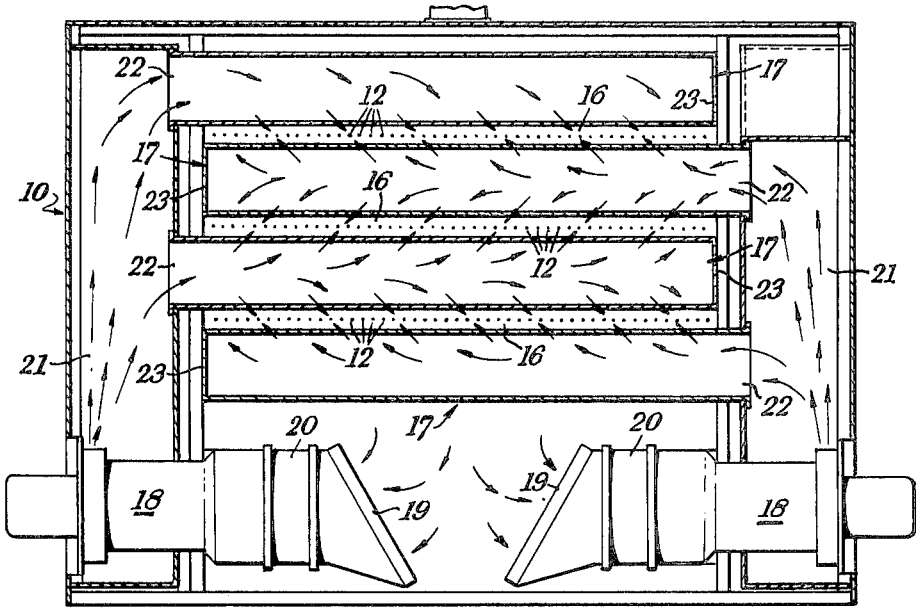
FIG. 2 is a section on the line II—II in FIG. 1.

Each pass constitutes a drying chamber 16, disposed between upper and lower nozzle boxes 17 through which hot air flows in opposite directions as indicated by the arrows in FIG. 2. Air is circulated through the casing 10 and the nozzle boxes 17 by fans 18, each of which draws in air through an associated filter 19 and a heater 20, and delivers air to associated nozzle boxes 17 through trunking 21.

Each nozzle box 17 has an open end 22 for the entry of hot air and is closed at the opposite end by a wall 23. The walls of the nozzle boxes which face the yarns are formed with slots 24 (FIGS. 3 and 4) constituting nozzles through which hot air is discharged from the nozzle boxes onto the yarns, each slot being bounded at one side by a deflector vane 25 for deflecting hot air into and through the slot.

Figure 3:
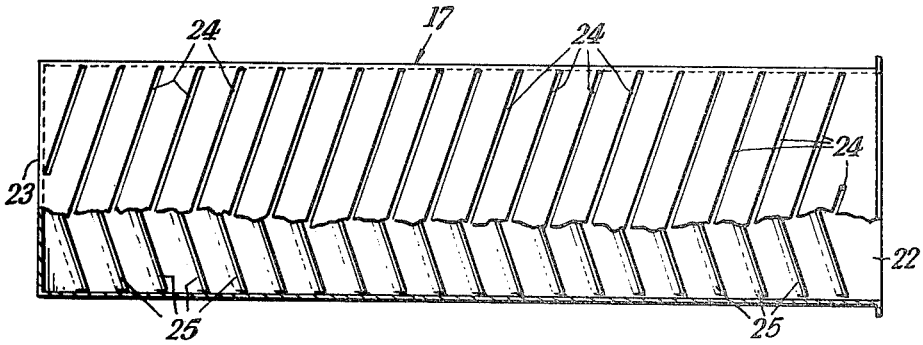
FIG. 3 is a plan view, partly broken away, of a nozzle box on a larger scale.
Figure 4:
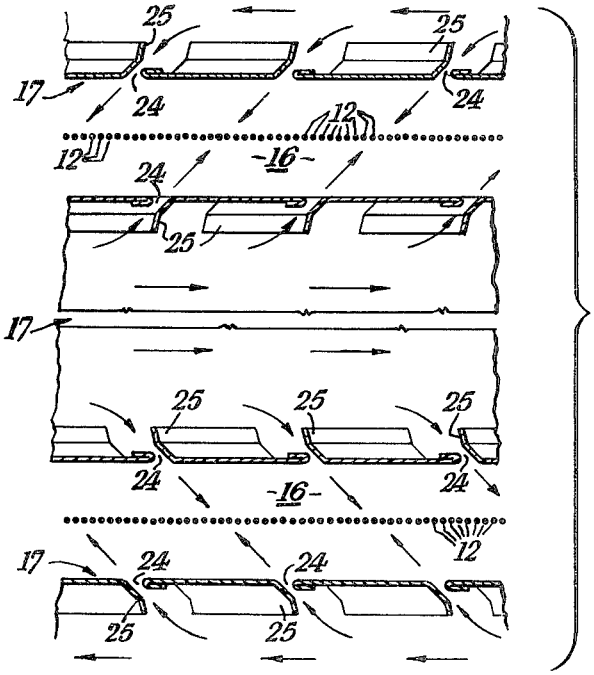
FIG. 4 is a sectional view, also on a larger scale, illustrating the passage of a sheet of yarns through the drying apparatus.

The air, in a typical case, is discharged from the slots 24 at a velocity of 4000 ft. per minute. As will be seen from FIG. 4 the direction of discharge is inclined to the vertical. The inclination to the vertical is preferably 30°. If the slots 24 in the nozzle boxes extended transversely to the direction of travel of the yarns 12, yarns might deviate from alignment with the streams of hot air flowing through the slots. The slots in a wall of a nozzle box above the yarns are therefore inclined to the transverse direction as shown in FIG. 3, and those in the wall of a nozzle box below the yarns are inclined to the transverse direction at the same angle but in the opposite direction.

In successive drying chambers the slanting of the slots in the associated nozzle boxes is reversed, i.e., the slanting of the slots in the nozzle box above the yarns in the first chamber corresponds to that in the nozzle box below the yarns in the next chamber.

Exhaust fans 26 are provided at the top of the casing 10.

The above-described drier can also be employed for drying a tufted carpet after application of synthetic rubber latex to the back thereof.

What we claim as our invention and desire to secure by Letters Patent is:

1. In a drier comprising an enclosed casing, means for feeding a sheet of parallel yarns to be dried through the casing in at least one substantially horizontal pass, nozzle boxes disposed above and below the sheet material in each pass to form a drying chamber, means for introducing hot air into the nozzle boxes, and slots in the walls of the nozzle boxes which face the sheet, the improvement comprising said slots being formed as nozzles effective to discharge hot air from each nozzle box onto the opposed surfaces of the sheet at an angle to the vertical in the range of 30° to 60° and the slots in the upper and lower boxes being slanted in opposite directions to the direction transverse to the direction of travel of the sheet.

2. A drier according to claim 1, wherein the slots discharge hot air at an angle of 30° to the vertical.

3. A drier according to claim 1, wherein each slot is bounded at one side by a deflector vane for deflecting hot air into and through the slot.

4. A drier according to claim 1, wherein the nozzles in the upper and lower boxes are inclined at equal angles to the direction transverse to the direction of travel of the sheet.

5. A drier according to claim 1, which includes means for guiding the sheet through the casing in a series of superposed passes, each forming a drying chamber, through which the sheet travels in opposite directions, the slanting of the slots in the nozzle boxes associated with successive drying chambers being reversed.

* * * * *